US007870632B1

(12) United States Patent
Schmader

(10) Patent No.: US 7,870,632 B1
(45) Date of Patent: Jan. 18, 2011

(54) POCKET GOLF BALL WASHER

(76) Inventor: Michael Thomas Schmader, 9460 Bay Hill Dr., Warren, OH (US) 44484

( * ) Notice: Subject to any disclaimer, the term of this patent is extended or adjusted under 35 U.S.C. 154(b) by 461 days.

(21) Appl. No.: 11/845,702

(22) Filed: Aug. 27, 2007

(51) Int. Cl.
*A63B 47/04* (2006.01)

(52) U.S. Cl. ..... 15/104.94; 15/104.93; 15/210.1; 15/244.1

(58) Field of Classification Search ..... 15/210.1, 15/104.93, 104.94, 244.1; 401/9, 11
See application file for complete search history.

(56) References Cited

U.S. PATENT DOCUMENTS 1,565,414 A 12/1925 Byrne
1,710,816 A * 4/1929 Evans ..... 15/104.92
2,572,349 A 10/1951 Kaplan
2,578,224 A 12/1951 Cadman
2,608,705 A 9/1952 Duff
2,622,257 A 12/1952 Lemonds et al.
3,098,252 A 7/1963 Sundquist
3,453,675 A 7/1969 Barton et al.
3,750,219 A 8/1973 MacConnell
4,084,287 A 4/1978 Ingram et al.
4,411,040 A 10/1983 Sharrow et al.
4,683,603 A * 8/1987 Purlia et al. ..... 15/104.94
4,965,906 A 10/1990 Mauro
5,339,486 A * 8/1994 Persic, Jr. ..... 15/244.1
6,036,386 A * 3/2000 McDonald ..... 401/10
6,148,464 A 11/2000 Shioda

* cited by examiner

*Primary Examiner*—Monica S Carter
*Assistant Examiner*—Stephanie Newton

(57) ABSTRACT

A portable golf ball cleaning device carried in a golfer's pocket for ball washing on the green. A cleaning element comprising a soft, flexible, absorbent material absorbs and retains a cleaning liquid and wipes a golf ball. An open container comprising a soft, flexible, resilient, waterproof material holds the cleaning element in a waterproof cavity formed by a bottom and a wall with an upper edge forming an opening. A mechanical fit or waterproof adhesive retains the cleaning element in the waterproof cavity. A vertical gap between the cleaning element and the upper edge of the wall keeps the cleaning element from prolonged contact with the pocket. A lateral cushion formed by the wall in the vertical gap keeps a ball engaged on the cleaning element during wiping. During play, cleaning liquid is added and the device is squeezed to adjust wetness and to clean the device. For ball cleaning, a ball is inserted through the opening and wiped on the cleaning element.

2 Claims, 2 Drawing Sheets

POCKET GOLF BALL WASHER

BACKGROUND OF THE INVENTION

This invention relates to a portable golf ball cleaning device to be carried in a golfer's pocket.

Golf balls are designed with aerodynamic surface characteristics, which can be altered by the presence of dirt or other surface contaminants thereby changing flight trajectory or distance qualities. The accurate roll of the ball on the green is also affected by dirt or debris on the ball. Additionally, dirt or stains on the ball are distracting when focusing on the ball during putting. The golf ball becomes dirty when coming into contact with the turf during play. According to the rules of golf, normally the ball may only be cleaned before putting on the green or before teeing off on the tee. Since putting accounts for over forty percent of all strokes in a golfer's score, a clean ball for putting is especially important. Also, if cleaned on the green before putting, the ball does not require further cleaning before teeing off on the next hole. Therefore, the green is considered the optimum point for cleaning a golf ball during play.

In order to clean the ball on the green, some golfers carry a wet towel on the cart or bag and carry the towel on the green. Most golfers clean the ball on the green by wiping it with their fingers or wiping it on their clothing or licking it. These methods are not only messy and ineffective but can be harmful to the health of the golfer due to chemicals on the green. Therefore, a portable device is needed for cleaning a golf ball on the green.

A number of portable devices have been developed for cleaning a golf ball during play, which are known in the art.

Cart ball washers have been designed to be located on a riding golf cart. U.S. Pat. No. 4,965,906 to Mauro discloses an example of such a device. However, a cart is not allowed on the green.

Bag ball washers have been designed to be located on or in a golf bag. U.S. Pat. No. 3,098,252 to Sundquist, U.S. Pat. No. 2,622,257 to Lemonds et al., U.S. Pat. No. 2,608,705 to Duff and U.S. Pat. No. 1,710,816 to Evans, disclose examples of such devices. However, a bag is not allowed on the green.

Belt ball washers have been designed to be located on a golfer's belt. U.S. Pat. No. 6,148,464 to Shioda, U.S. Pat. No. 4,084,287 to Ingram et al., U.S. Pat. No. 3,453,675 to Barton et al. and U.S. Pat. No. 2,572,349 to Kaplan, disclose examples of such devices. Although, these devices can be carried on the green, the belt location interferes with the swing and movement of arms and hands during play and also detracts from a golfer's appearance.

The only practical location for carrying a golf ball cleaning device on the green is in a golfer's pocket.

The Cart, Bag and Belt devices in the prior art have problems and disadvantages, including but not limited to one or more of the following:

(a) the device cannot be carried in a golfer's pocket due to a large size which cannot be reduced sufficiently without changing the technology;

(b) the device cannot be carried dryly in a golfer's pocket due to a design allowing liquid to leak into the pocket or allowing a wet cleaning means to come into prolonged contact with the pocket.

(c) the device is not economical to produce due to the design complexity, the number of parts, the assembly process and the cost of materials.

Pocket Closed Container ball washers have been designed to be carried in a golfer's pocket. U.S. Pat. No. 4,411,040 to Sharrow et al., U.S. Pat. No. 3,750,219 to MacConnell, U.S. Pat. No. 2,578,224 to Cadman and U.S. Pat. No. 1,565,414 to Byrne, disclose examples of such devices. These devices require a sealed lid in order to prevent cleaning liquid from leaking into a golfer's pocket.

The Pocket Closed Container devices in the prior art have problems and disadvantages, including but not limited to one or more of the following:

(d) the device cannot be carried comfortably in a golfer's pocket due to rigid or heavy structure required to meet strength needs of a sealed lid;

(e) the device cannot be carried quietly in the pocket due to rigid or hard structure required to meet strength needs of a sealed lid, thereby rattling against other objects carried in the pocket;

(f) the device does not provide quick ball cleaning due to a lid which must be removed before cleaning and replaced after cleaning;

A Pocket Open Container ball washer has been designed to be carried in a golfer's pocket. U.S. Pat. No. 4,683,603 to Purlia et al. discloses this device. The device consists of an only partially absorbent cleaning means and a holder means having an opening with an inwardly extending lip to prevent cleaning liquid from leaking into the pocket.

The Pocket Open Container device in the prior art has problems and disadvantages, including but not limited to the following:

(g) the device does not provide effective ball cleaning due to an inwardly extending lip above the upper surface of the cleaning means thereby limiting ball wiping area on the upper surface of the cleaning means;

(h) the device does not provide effective ball cleaning due to a cleaning means utilizing a non-absorbent material for ball contact, which provides for brushing and scrubbing, but not for wiping and absorbing;

(i) the device is not easy to adjust for the degree of wetness due to a cleaning means consisting only partially of absorbent material and due to an inwardly extending lip above the upper surface of the cleaning means, thereby limiting wetness adjustment to an opening facing down position in which all unabsorbed cleaning liquid flows from the device in an uncontrolled manner;

(j) the device is not easy to keep clean due to an inwardly extending lip above the upper surface of the cleaning means, which creates spaces in which dirt and debris can accumulate with no easy means of removal.

SUMMARY OF THE INVENTION

An economical golf ball cleaning device, which can be carried dryly, comfortably and quietly in a golfer's pocket, provides quick and effective ball washing on the green, and is easy to adjust for wetness and to keep clean. A cleaning element comprising a soft, flexible, absorbent material, absorbs and retains a cleaning liquid and wipes a golf ball. An open container comprising a soft, flexible, resilient, waterproof material, holds the cleaning element in a waterproof cavity formed by a bottom and a wall with an upper edge forming an opening. A mechanical fit or waterproof adhesive retains the cleaning element in the waterproof cavity. A vertical gap between the cleaning element and the upper edge of the wall keeps the cleaning element from prolonged contact with a pocket. A lateral cushion formed by the wall in the vertical gap keeps a ball engaged on the cleaning element during wiping. During play, cleaning liquid is added and the device is squeezed to adjust wetness or to clean the device. For ball cleaning, a ball is inserted through the opening and wiped on the cleaning element.

The present invention solves problems with device technologies in the prior art and has objectives and advantages, including but not limited to the following:

(a) the device can be carried on the green in a golfer's pocket due to a small size;

(b) the device can be carried dryly in a golfer's pocket due to the absorbent cleaning element which retains adequate cleaning liquid for ball cleaning and the vertical gap which keeps the wet cleaning element from coming into prolonged contact with the pocket.

(c) the device is economical to produce due to simple design, construction of few parts, a simple assembly and inexpensive materials.

(d) the device an be carried comfortably in a golfer's pocket due to the soft, flexible, lightweight open container;

(e) the device can be carried quietly in a pocket due to the soft, flexible open container, which does not rattle against other objects in a pocket;

(f) the device provides quick ball cleaning on the green due to the open container with the exposed cleaning element;

(g) the device provides effective ball cleaning due to the soft, flexible, resilient open container with the unobstructed opening above the upper surface of the cleaning element, which maximizes ball wiping area on the upper surface, and due to the lateral cushion, which keeps a ball engaged on the cleaning element during wiping and mitigates lateral shock;

(h) the device provides effective ball cleaning due to the cleaning element comprised of soft, absorbent material for contacting a ball thereby providing wiping and absorbing;

(i) the device is easy to adjust for the degree of wetness due to the cleaning element comprised entirely of absorbent material and due to the flexible open container, which is unobstructed above the upper surface of the cleaning element, thereby providing for wetness adjustment in nearly any device position and only excess unabsorbed liquid squeezed from the cleaning element flowing from the device in a controlled manner;

(j) the device is easy to keep clean due to the flexibility and resilience of the open container and a design with no spaces in which dirt can accumulate such that the device is easily cleaned by simply rinsing with water and squeezing.

Further objects and advantages of the invention become apparent from a consideration of the drawings and the description.

DETAILED DESCRIPTION OF THE INVENTION

Figure 1:
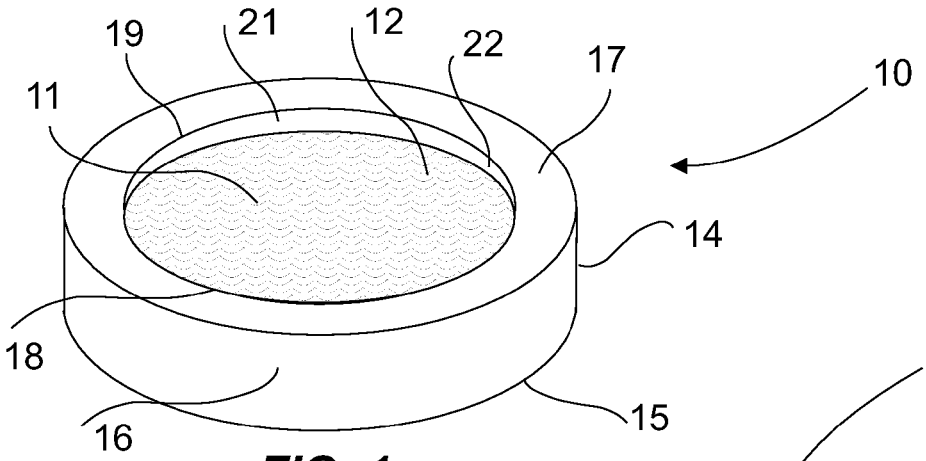
FIG. 1 is a perspective of a preferred embodiment of the device.
Figure 2:
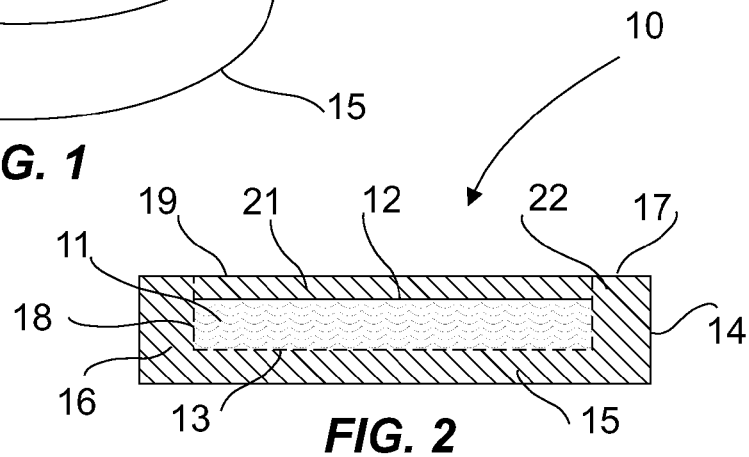
FIG. 2 is a cross section of a preferred embodiment of the device.

Referring now to FIGS. 1-2, shown therein are views of a preferred embodiment of the device 10. A cleaning element 11 has an upper surface 12 and a lower surface 13. The cleaning element 11 is comprised of soft, flexible, absorbent material, which is preferably a lightweight open cell sponge or similar material. The cleaning element 11 has sufficient volume for absorbing and retaining an adequate amount of a cleaning liquid for cleaning a golf ball multiple times and for absorbing dirt wiped from a golf ball. Only infrequent additions of cleaning liquid are required during a round of golf depending on playing conditions. The upper surface 12 of the cleaning element 11 has sufficient area to wipe a golf ball. Preferably, the cleaning element 11 has a substantially circular shape, which is optimal for wiping a round golf ball. An open container 14 holds the cleaning element 11. The open container 14 is constructed of soft, flexible, resilient, waterproof material, which is preferably a lightweight closed cell foam or similar material. The open container 14 has a bottom 15 and a wall 16 reaching upwardly from the bottom 15 to an upper edge 17 of the wall 16. The bottom 15 and the wall 16 form a waterproof cavity 18. The upper edge 17 of the wall 16 forms an opening 19 in the waterproof cavity 18. Preferably, the size of the opening 19 is such that the upper surface 12 of the cleaning element 11 is substantially or fully exposed and allows the insertion of a substantial portion of a golf ball for wiping on the cleaning element 11. A mechanical fit or a waterproof adhesive secures the cleaning element 11 within the waterproof cavity 18. The waterproof cavity 18 has a height greater than the height of the cleaning element 11 such that a vertical gap 21 is formed between the upper surface 12 of the cleaning element 11 and the upper edge 17 of the wall 16. The vertical gap 21 has sufficient size such that normal tension of pocket material keeps the cleaning element 11 from coming into prolonged contact with a pocket. The wall 16 contiguous with the vertical gap 21 forms a lateral cushion 22. The lateral cushion 22 has sufficient size to provide adequate resistance to the lateral forces exerted by a ball during wiping thereby keeping a ball engaged on the cleaning element 11 without requiring visual attention. The lateral cushion 22 has adequate softness, flexibility and resilience to mitigate lateral shock. Preferably, the open container 14 has a substantially circular shape, which further optimizes resistance to lateral forces due to hoop strength. The open container 14 is sized to be sufficiently small in breadth and height to fit comfortably in a golfer's pocket. Preferably, the open container 14 has a substantially flat bottom 15 to further minimize height and improve fit in a pocket.

Figure 3:
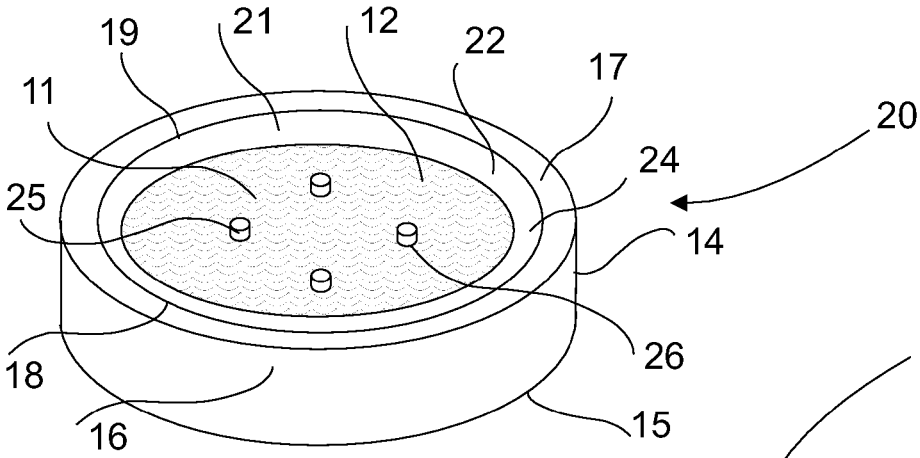
FIG. 3 is a perspective of an alternate embodiment of the device.
Figure 4:
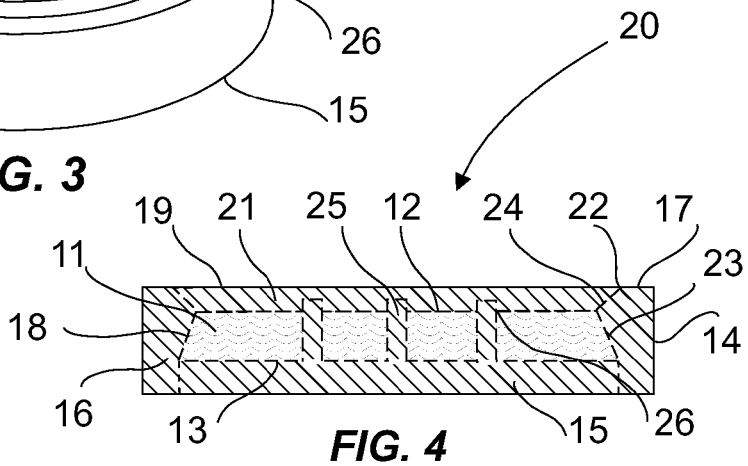
FIG. 4 is a cross section of an alternate embodiment of the device.

Referring to FIGS. 3-4, shown therein are views of an alternate embodiment of the device 20 with modifications to the preferred embodiment. The wall 16 of the open container 14 contiguous with the cleaning element 11 has an inner surface 23 inclining inwardly to provide an improved mechanical fit for retaining the cleaning element 11 in the waterproof cavity 18 and to further retain excess cleaning liquid in the cleaning element 11. The lateral cushion 22 has an inner surface 24 inclining outwardly to further increase the area of the upper surface 12 of the cleaning element 11 accessible for golf ball wiping. The open container 14 has one or more projections 25 reaching upwardly from said bottom 15 and said cleaning element 11 has one or more holes 26 reaching upwardly from said lower surface 13 to said upper surface 12 such that said projections 25 pass through said holes 26 to a level above said upper surface 12 of said cleaning element 11 thereby further keeping said cleaning element 11 from prolonged contact with a golfer's pocket. The bottom 15 and the wall 16 of the open container 14 are separate pieces joined by a waterproof adhesive or a mechanical fit.

Figure 5:
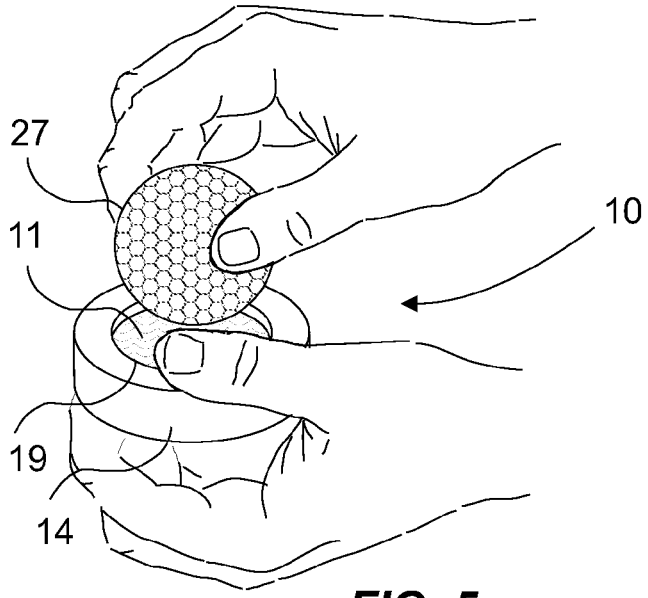
FIG. 5 is a perspective of a golf ball being wiped on a preferred embodiment of the device.
Figure 7:
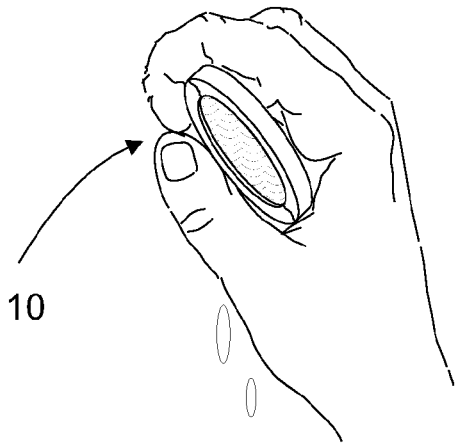
FIG. 7 is a perspective of a preferred embodiment of the device being squeezed to adjust the degree of wetness or to clean the device.
Figure 6:
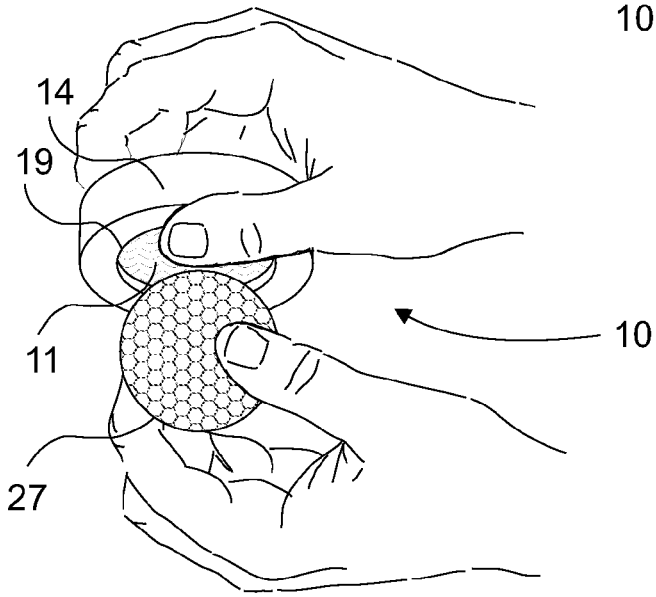
FIG. 6 is a perspective of a preferred embodiment of the device being wiped on a golf ball.

Referring to FIGS. 5-7, shown therein are perspective views of a preferred embodiment of the device 10 in operation. During play, a cleaning liquid is added to the cleaning element 11 and the device 10 is squeezed to adjust the degree of wetness as shown in FIG. 7. To wash a ball 27 clean, the device 10 is held with one hand, and the ball 27, held in the other hand, is inserted through the opening 19 of the open container 14 and wiped on the cleaning element 11 as shown in FIG. 5, or the cleaning element 11 is wiped on the ball 27 as shown in FIG. 6. During play, the device 10 is cleaned by simply rinsing with water and squeezing as shown in FIG. 7. Between rounds the device 10 can be left to air dry.

While the above description contains many specificities, these should not be construed as limitations to the scope of the invention, but only as exemplifications of the presently preferred embodiments thereof. It will be evident to those skilled in the art that other various changes and modifications may be made therein without departing from the spirit of the invention.

What is claimed is:

1. A portable golf ball cleaning device carried in a golfer's pocket, comprising: a cleaning element having an upper surface and a lower surface, said cleaning element comprising a soft, flexible, absorbent material, said cleaning element of sufficient size to absorb and retain an adequate amount of a cleaning liquid for cleaning a golf ball and to wipe a portion of a golf ball on said upper surface, said cleaning element having a hole or multiple holes reaching upwardly from said lower surface to said upper surface; an open container holding said cleaning element, said open container comprising a soft, flexible, resilient, waterproof material, said open container having a bottom and a wall reaching upwardly from said bottom, said bottom and said wall forming a waterproof cavity, said wall having an upper edge, said upper edge forming an opening in said waterproof cavity, said waterproof cavity containing said cleaning element, said waterproof cavity having a height greater than the height of said cleaning element thereby forming a vertical gap between said upper surface of said cleaning element and said upper edge of said wall, said vertical gap of sufficient size to keep said cleaning element from prolonged contact with a golfer's pocket when carried therein, said wall contiguous with said vertical gap forming a lateral cushion, said lateral cushion of sufficient size to keep a golf ball engaged on said cleaning element during wiping, said open container sized to fit in a golfer's pocket, said open container having a projection or multiple projections reaching upwardly from said bottom such that said projections pass through said holes in said cleaning element to a level above said upper surface of said cleaning element; and a securing means for retaining said cleaning element in said waterproof cavity.

2. The portable golf ball cleaning device according to claim 1, wherein said lateral cushion has an inner surface inclining outwardly.

* * * * *